United States Patent [19]

Tigwell et al.

[11] Patent Number: 4,620,190

[45] Date of Patent: Oct. 28, 1986

[54] METHOD AND APPARATUS FOR SIMULTANEOUSLY ACTUATING NAVIGATIONAL LANTERNS

[75] Inventors: David C. Tigwell, Spring; Marion L. Recane, Houston, both of Tex.

[73] Assignee: Tideland Signal Corporation, Houston, Tex.

[21] Appl. No.: 635,977

[22] Filed: Jul. 30, 1984

[51] Int. Cl.[4] ..... G08G 3/00

[52] U.S. Cl. ..... 340/985

[58] Field of Search ..... 340/985, 331; 315/88, 315/89

[56] References Cited

U.S. PATENT DOCUMENTS 3,781,853 12/1973 Jacobs ..... 340/29

3,855,586 12/1974 Jacobs ..... 315/89

*Primary Examiner*—Jerry W. Myracle

*Attorney, Agent, or Firm*—Fulbright & Jaworski

[57] ABSTRACT

A method and apparatus for causing a plurality of navigational lanterns, each equipped with an independent light sensing device and connected to a common synchronizing terminal, to actuate simultaneously at dusk, and deactuate simultaneously at dawn. The light sensing device senses the three levels of day, twilight and night. When a sensing device senses day, the connected lantern is disabled from flashing and is disabled from sending a synchronizing signal to other lanterns to flash. When a sensing device senses twilight, the connected lantern is enabled to receive the synchronizing signal, but is disabled from sending a synchronizing signal. When the sensing device senses night, the connecting lantern is enabled and a synchronizing signal to flash is sent to all of the lanterns.

8 Claims, 6 Drawing Figures

Fig. 1

10 12 14 16

| TRUTH TABLE | | | |
|---|---|---|---|
| SENSOR OUTPUT | DAY | TWILIGHT | NIGHT |
| RESPONSE | NEVER FLASH OR SEND SYNC | FLASH ONLY WHEN SYNC IS RECIEVED DONT SEND SYNC. | FLASH AND SEND SYNC |

18 20 22

Fig. 2

| | LANTERN 1 | LANTERN 2 | LANTERN 3 | LANTERN 4 |
|---|---|---|---|---|
| 24 | DAY 30 | DAY | DAY | DAY |
| 26 | TWILIGHT | TWILIGHT | TWILIGHT | TWILIGHT 36 |
| 28 | NIGHT | NIGHT | NIGHT | NIGHT |

32 34

Fig. 3

| | LANTERN 1 | LANTERN 2 | LANTERN 3 | LANTERN 4 36a |
|---|---|---|---|---|
| 24 | DAY 30 | DAY | DAY | DAY |
| 26 | TWILIGHT | TWILIGHT | TWILIGHT | TWILIGHT |
| 28 | NIGHT | NIGHT | NIGHT | NIGHT |

32 34

Fig. 4

| | LANTERN 1 | LANTERN 2 | LANTERN 3 | LANTERN 4 |
|---|---|---|---|---|
| 24 | DAY 30 | DAY | DAY 34 | DAY |
| 26 | TWILIGHT | TWILIGHT | TWILIGHT | TWILIGHT |
| 28 | NIGHT | NIGHT | NIGHT | NIGHT 36b |

32

METHOD AND APPARATUS FOR SIMULTANEOUSLY ACTUATING NAVIGATIONAL LANTERNS

BACKGROUND OF THE INVENTION

Navigational lighting systems in many locations are not easily accessible, must operate with high reliability in order to provide safety, and be autonomously powered. The electrical power, which is generally batteries, and the lamps are conserved by operating only at night, and are turned off in the daytime by light sensors.

In order to avoid possible ambiguity to mariners, it is desirable to have all lanterns marking a channel, hazard, or structure to light or flash at the same time at dusk, and to extinguish simultaneously at dawn. This is difficult to accomplish by independent light sensing devices connected to each of the lanterns because (1) available light sensors are difficult to calibrate, compensate, and do not track each other well, (2) in extreme northern and southern latitudes, the transition from night to day may be quite slow, thereby causing lanterns only slightly out of calibration to light and extinguish far apart from each other in time, and (3) shading of the light sensor by other structures causes orientation sensitivity and sensitivity to the sun angle.

In U.S. Pat. No. 3,781,853, a navigational light system is disclosed in which all of the lanterns flash in unison and are actuated by a synchronizing signal initiated by the first lantern to be actuated. That system synchronized all of the navigational lights and insured that in the event one of the lanterns failed, the remainder of the lanterns would operate.

However, the present systems utilize a single light measuring threshold point at the output of the light sensors to define the boundary between day and night. If the output of the sensor is above the threshold (day condition), flashing of the lantern is inhibited, and if below the threshold (night conditions), flashing is enabled. All of the lanterns send synchronizing pulses at the beginning of each flash code sequence to all of the lanterns to actuate all of the lanterns that are not inhibited.

The present invention is directed to an improved method and apparatus for synchronizing a plurality of navigational lanterns by compensating for the fact that the independent light sensors connected to each of the lanterns respond differently to the light levels as well as allow the system to operate even in the event of a light level sensor failure.

SUMMARY

The present invention is directed to a method of and an apparatus for simultaneously actuating a system of navigational lanterns each of which is equipped with an independent light level sensing means and in which each sensing means measures the thresholds between day, twilight and night. When a sensor is measuring day, its connected lantern is disabled from flashing and the connected lantern is disabled from providing a synchronising signal to the other lanterns. When a sensor measures twilight, the connected lantern is enabled, so as to flash if a synchronization signal is received from other lanterns, but is disabled from providing a synchronizing signal to other lanterns. And if a sensor measures night, the connected lantern is enabled and provides a synchronizing signal to operate itself and the other lanterns.

Another object of the present invention is the provision of a navigational lantern system having a plurality of navigational lanterns in which each lantern includes means for providing a synchronizing signal to actuate a lantern and each lantern includes a synchronizing terminal and the input and output from each lantern is connected to the synchronizing terminal of the other lanterns in the system and in which each lantern has an improved light level sensing means. Each light level sensing means senses the thresholds of day, twilight and night. Means are connected to each sensing means, when the sensing means senses day, for disabling the connected lantern and disabling the means for providing a synchronizing signal from the connected lantern. Means are also connected to the sensing means, when the sensing means senses twilight, enabling the connected lantern to receive a synchonizing signal, but disabling the means for providing a synchronizing signal from the connected lantern. And means are connected to each sensing means, when the sensing means senses night, enabling the connected lantern for lighting and enables the means for providing a synchronizing signal from the connected lantern to the other lanterns.

Yet a still further object of the present invention is wherein the sensing means includes a photodetector having a resistance which varies inversely proportional to the light intensity. Means are connected to the photodetector transmitting electric current thereto and means are connected to the photodetector for measuring three different levels of light illuminating the photodetector.

Still a further object of the present invention is the method of synchronizing a plurality of navigational lanterns at dawn and dusk which includes sensing at each of the lanterns the levels of day, twilight and night. When each of the lanterns senses day, disabling the day sensing lantern. When each of the lanterns senses twilight, enabling the lantern to flash but only if the lantern receives a synchronization signal from another lantern. And each of the lanterns when it senses night, enables and flashes the lantern and also sends the synchronization signal to the other lanterns to flash.

Other and further objects, features and advantages will be apparent from the following description of the presently preferred embodiment of the invention, given for the purpose of disclosure and taken in conjunction with the accompanying drawings.

BRIEF DESCRIPTION OF THE DRAWINGS

FIG. 1 is a truth table indicating the response of a sensor to various levels of surrounding illumination, FIG. 2 is a chart illustrating the operation of a plurality of lanterns utilizing light level sensors which respond differently to the light level, FIG. 3 is a graph illustrating the response of a plurality of lanterns having independent light sensors with varying responses in which one of the light sensors has failed in a mode indicating a day condition, FIG. 4 is a graph illustrating the response of a plurality of navigational lanterns having independent light sensors with varying responses in which one of the light sensors has failed in a mode continuously indicating a night condition.

Figure 5:
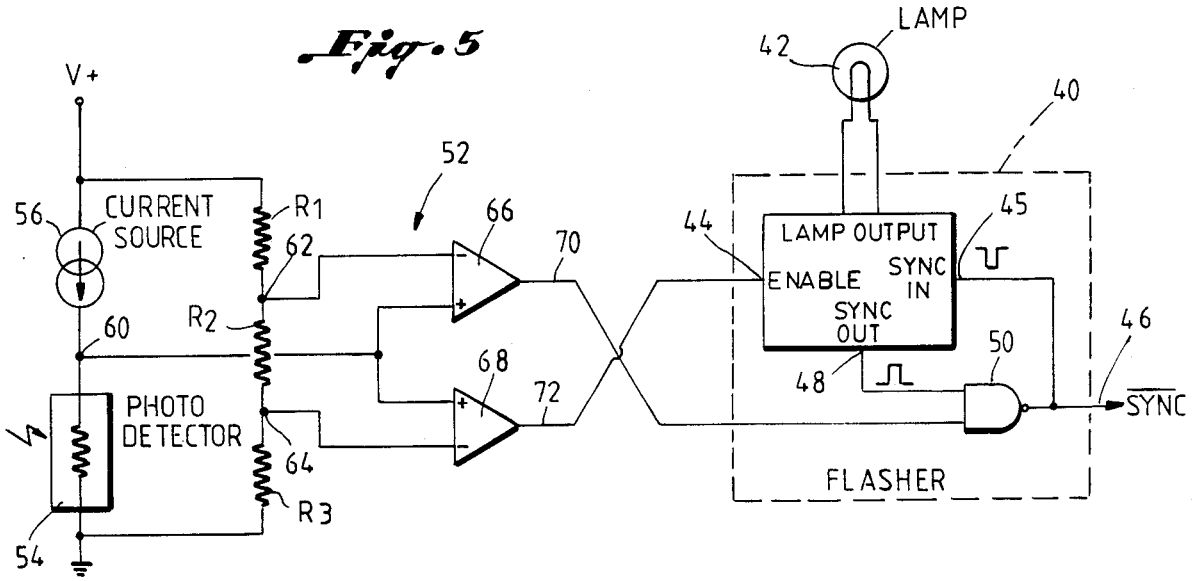
FIG. 5 is an electrical schematic diagram illustrating one type of structure for implementing the present invention.

Referring now to U.S. Pat. No. 3,781,853 which is incorporated herein by reference, a portion of a navigational light system is shown in which all of the lanterns are connected together to a synchronizing terminal to aid the lanterns to flash in unison. Each lantern is independent and is equipped with an independent light-sensing means such as the daylight control. In that system, a single threshold point at the output of the light sensor defines the boundary between night and day. In that system, if the output of the light level sensing means is above the threshold (day condition) then flashing of the lanterns is inhibited. If the output is below the threshold (night condition) flashing is enabled and also the connected lantern sends a synchronizing pulse to flash the other lanterns if their light level sensors are sensing night. As has been indicated above, it is difficult to calibrate all of the independent light sensors to simultaneously detect the threshold between day and night. Therefore, it is difficult to obtain the simultaneous operation of all of the lanterns in the system to light at the same time at dusk and to extinguish simultaneously at dawn.

In the present method and apparatus, two thresholds are established, defining each of the sensors' output into three regions referred to as night, twilight and day. Each lantern flashes at night when its sensor detects night and is extinguished during the day if its light sensor senses daylight. However, when a sensor's output falls between the two thresholds (twilight), a lantern will be enabled so that it will flash only if a synchronizing pulse is received. A lantern measuring the twilight condition will not send synchronizing pulses to the other lanterns. The spacing between the two thresholds is selected to establish the desired width of the twilight region and is preferably set slightly wider than the spread of the individual sensor outputs of the individual lanterns caused by the factors which create a difference in response between the individual light sensors. As previously indicated, the difference is caused by (1) the individual light sensors are difficult to calibrate, compensate and do not track each other well, (2) in extreme northern and southern latitudes, the transition from night to day may be quite slow causing the sensor's response to be apart from each other in time, and (3) shading of one or more sensors by other structures causes changes in the sensor output due to orientation sensitivity and sensitivity to sun angles.

In order to accomplish the method and function of the present invention, as best seen in FIG. 1, a truth table, generally indicated by the reference numeral 10 indicates the output or response of each individual light level sensor to the measured condition of day 12, twilight 14, and night 16. That is, the output or response to the light level sensor when it measures day is the response 18 which indicates that the connected lantern never flashes or sends a synchronizing signal. In response to a measurement of the twilight 14, the output of the measuring light level sensor is 20 which indicates that the lantern is enabled to flash but only when a synchronizing signal is received from other lanterns and the lantern is inhibited from sending a synchronizing signal to the other lanterns. And as indicated in response block 22, when the light level sensor senses night 16, the connected lantern will be enabled, will flash, and will send a synchronizing signal to the other lanterns so that they will simultaneously flash if they are not inhibited.

Referring now to FIG. 2, a plurality of lanterns, such as four for illustration only, are connected in a navigational system and are designated as lantern 1, lantern 2, lantern 3 and lantern 4. Each of the lanterns has an independent light level sensor suitable for measuring light intensities corresponding to day 24, twilight 26 and night 28. A twilight 26 output can be either dawn or dusk. For purposes of illustration, the individual light level sensors output for each of the individual lanterns is indicated by an arrow. Thus, the sensor of lantern 1 has an output 30 indicating that the sensor of lantern 1 is measuring a twilight light intensity. The sensor of lantern 2 as indicated by arrow 32 is measuring a night light level. The sensor of lantern 3 as indicated by the arrow 34 is measuring twilight and the sensor of lantern 4 as indicated by the arrow 36 is measuring a twilight light level. Under the conditions indicated in FIG. 2, assuming the light is going from dusk to night and referring to the truth table in FIG. 1, the sensor levels 30, 34 and 36 are all in the twilight zone whereby the sensors of lanterns 1, 3 and 4 are enabled to flash, but only if a synchronizing signal is received from another lantern and lanterns 1, 2 and 4 will not send synchronizing signals. However, since the sensor of lantern 2 has a level 32 in the night zone, lantern 2 will flash, and will send synchronizing signals to lanterns 1, 3 and 4. Therefore, all of the lanterns will flash in synchronism because of the sensor level 32 of lantern 2. As night continues to fall, the sensors of lanterns 1, 3 and 4 will eventually measure a night level 28 and therefore all of the lanterns will send a synchronizing signal and the first synchronizing signal will cause all of the lanterns to flash in unison.

On the other hand, assuming that the navigational light system of FIG. 2 is moving from a night condition to a day condition, all of the lanterns 1, 2, 3 and 4 would flash in synchronism until the last sensor, the sensor of lantern 2, moves out of the night 28 condition into the twilight 26 condition at which time all of the lanterns would be extinguished as no synchronization pulses would be generated.

It is desirable that the width of the measured twilight region 26 be set slightly wider than the spread of the individual sensor outputs 30, 32, 34 and 36 so that one sensor output will not be measuring night while another is measuring day. If the width of the region 26 is wider than the individual sensor outputs, then the system will always operate in unison.

It is also important that the system be constructed and operated so that a failure in one or more of the level light sensors does not unduly affect the operation of the system.

Referring now to FIG. 3, the operation of which is similar to that in FIG. 2 with the exception that lantern 4 has a sensor which has failed and has a level **36*a* giving an erroneous "day" indication at all times. Again, the operation of the system in FIG. 3 is the same as the operation of the system in FIG. 2 with the exception that lantern 4 remains off at all times. Again, the system will flash and light lanterns 1, 2 and 3 when the light level sensor of lantern 2 detects a level 32 in the night zone 28. And on changing from night to day when the last sensor here, the sensor of lantern 2 moves out of the night zone 28 all of the lanterns 1, 2 and 3** will extinguish as there will be no synchronization pulses from any of the sensors.

Referring now to FIG. 4, a system is shown in which the sensor of lantern No. 4 has failed and has an output reading of 36*b* at all times to give an erroneous "night" reading. A failure of this type causes all of the lanterns 1, 2 and 3 to begin flashing as soon as its independent sensor output crosses from the day zone 24 to the twilight zone 26. Thus, under the sensor levels indicated in FIG. 4, lanterns 1 and 2 would be flashing due to the synchronous signals sent out by the sensor of lantern 4 but since the sensor of lantern 3 has a level 34 still in the daylight zone 24, then lantern 3 would not be simultaneously flashing with the other lanterns. Similarly, assuming that night is turning into day, the lanterns 1, 2 and 3 would continue to flash until their sensors sense the daylight zone 24 in which case they would be extinguished. Therefore a failure of the type shown in FIG. 4 will cause the simultaneously on/off feature not to function, but it will not be any more disadvantageous than the presentday systems.

There are various possible implementations of the method and operation previously described.

Referring now to FIG. 5, one type of structure is best seen having a flasher 40 such as one sold under the trademark SYNCHROSTAT by Tideland Signal Corporation for flashing a conventional navigational light 42. The flasher 40 includes and enable input port 44 for allowing operation of the flasher 40 or inhibiting the operation of the flasher 40. The flasher 40 also includes a synchronous input port 45 which is connected to a system synchronous line or terminal 46 to the remainder of the lanterns in the system for receiving an actuating pulse from other lanterns or from the flasher 40. That is the flasher 40 also includes a synchronous output 48 which is connected to the input of an NAND gate 50 for providing a synchronous signal which is transmitted both to the synchronous terminal 46 and to the input port 45 of the flasher 40.

A light level sensing means is generally indicated by the reference numeral 52 and includes a photodetector 54 which is a variable resistance device in which the resistance is inversely proportional to the incident light intensity. An electrical current source 56 supplies current through the photodetector to cause a voltage to appear at node 60 according to the IR drop across the current source 56. Resistors R1, R2 and R3 form a voltage divider establishing fixed voltages at nodes 62, and 63. During the "daylight" hours, the voltage at node 60 is lower than the voltage at nodes 62 and 64. This daylight condition causes the voltage comparators 66 and 68 to produce a logic low voltage at nodes 70 and 72, respectively. The logic low of node 72 is applied to the enable port 44 of the flasher 40 causing the flasher 40 to remain inactive.

As day changes toward night, the resistance of the photodetector 5 increases and the voltage at node 60 eventually exceeds the voltage at node 64 which causes the comparator 68 to change state thereby driving node 72 to HIGH. This is the twilight condition. A logic HIGH at the enable port 44 of the flasher 40 will cause the flasher 40 to initiate a flash code sequence upon receipt of a synchronization pulse on the synchronous port 45. Therefore, if another lantern in the system provides a synchronization signal to terminal 46, the lantern in the twilight condition will flash. However, any synchronous output from the port 48 is not gated through NAND gate 50 to the terminal 46.

When the night condition is measured by the photodetector 54, its resistance is high enough to drive the voltage at node 60 above that at node 62. This causes voltage comparetor 66 to change state, thereby driving node 70 to HIGH. This, in turn, gates a sync out signal from port 48 through the NAND gate 50 to the sync terminal 46 for transmission to the other lanterns.

Figure 6:
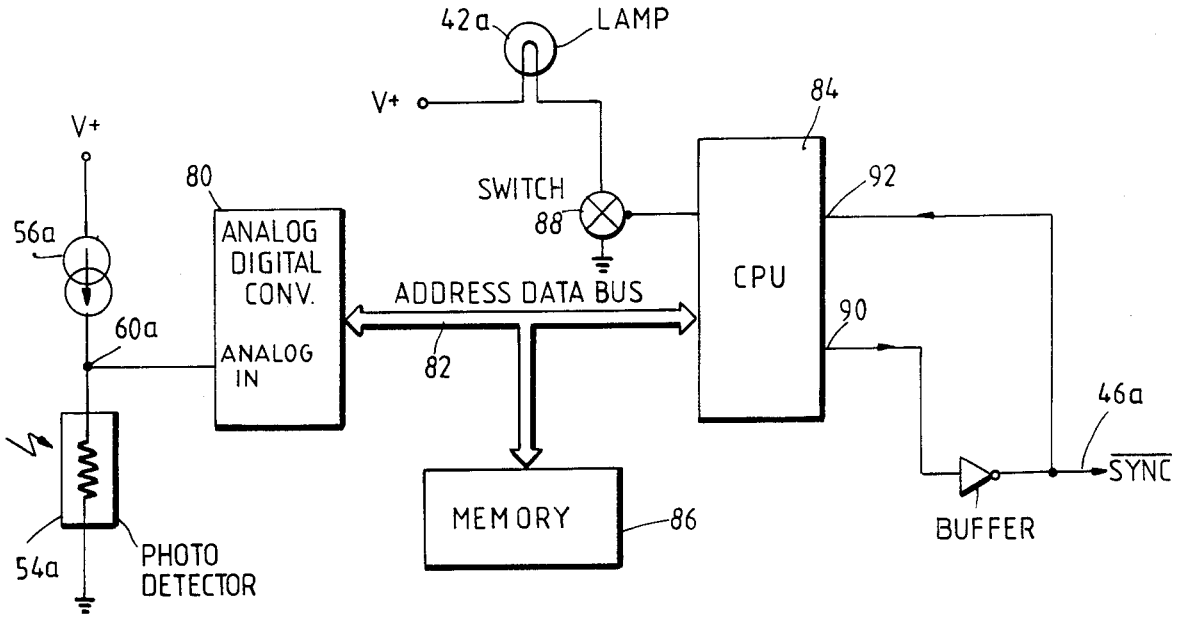
FIG. 6 is an electrical schematic diagram illustrating another structure for implementing the present invention.

Another implementation of the invention is best seen in FIG. 6 having a photodetector 54*a* connected to a current source 56*a* to provide a voltage output at node 60*a* which is proportional to the light intensity encountered by the photodetector 54*a*. The voltage at node 60*a* is transmitted through an analog to digital converter 80 to provide a digital signal which is transmitted over a computer address/data buss 82 to a microprocessor 84 which is connected to a memory 86. The microprocessor 84 compares the digital representation of the allumination level measured by the photodetector 54*a* relative to the daylight, twilight and night thresholds stored in the memory 86. The truth table shown in FIG. 2 is implemented in the microprocessor 84 and memory 86 to inhibit the switch 88 in the event of a daylight signal, to enable the switch 88 in the event of a twilight signal and to send out a synchronous pulse signal from the output 90 to the synchronizing terminal 46*a* and to receive pulses on the input port 92.

The present invention, therefore, is well adapted to carry out the objects and attain the ends and advantages mentioned as well as other inherent therein. While presently preferred embodiments of the invention have been given for the purpose of disclosure, numerous changes in the details of construction and arrangement of parts and steps of the method will readily suggest themselves to those skilled in the art and which are encompassed within the spirit of the invention and the scope of the appended claim.

What is claimed is:

1. In a navigational lantern system having a plurality of navigational lanterns, each lantern including means for providing a synchronizing signal, each lantern including a synchronizing terminal for actuating the lantern, and the input and output from each lantern connected to the synchronizing terminal of the other lanterns, and a light level sensing means connected to each lantern, the improvement in the light level sensing means comprising, each light level sensing means sensing the thresholds of day, twilight, and night, means connected to the sensing means, when the sensing means senses day, for disabling the connected lantern and disabling the means for providing a synchronizing signal from the connected latern, means connected to each sensing means, when the sensing means senses twilight, enabling the connected lantern to receive a synchronizing signal, but disabling the means for providing a synchronizing signal from the connected lantern, and means connected to each sensing means, when the sensing means senses night, enabling the connected lantern for lighting, and enabling the means for providing a synchronizing signal from the connected lantern.

2. The apparatus of claim 1 wherein the width of the twilight measurement is greater than the spread of the outputs of the individual light level sensing means.

3. The apparatus of claim 1 wherein the width of the twilight measurement is wide enough to preclude one sensor output measuring night while another sensor output is measuring day.

4. In a navigational lantern system having a plurality of navigational lanterns, each lantern including means for sending and receiving a synchronizing signal to and from other lanterns, the improvement in a light level sensing means connected to each lantern comprising, each sensing means sensing the thresholds of day, twilight, and night, switching means connected to each sensing means, each switching means, when the connected sensing means senses day, disabling the connected lantern and its means for sending a synchronizing signal, said switching means, when the connected sensing means senses twilight, enabling the connected lantern to receive a synchronizing signal, but disabling the connected lantern's means from sending a synchronizing signal, and said switching means, when the connected sensing means senses night, enabling the connected lantern and enabling the connected lantern's means for sending a synchronizing signal.

5. The apparatus of claim 4 wherein the sensing means includes, a photodetector having a resistance which varies inversely proportional to the light intensity, and means connected to the photodetctor for measuring the three different levels of light illumination on the photodetector.

6. The apparatus of claim 4 wherein, the width of the twilight measurement is wide enough to preclude one sensor output measuring night while another sensor output is measuring day.

7. The method of synchronizing a plurality of navigational lanterns at dawn and dusk comprising, sensing at each of the lanterns the levels of day, twilight, and night, disabling, when a lantern senses day, enabling, when a lantern senses twilight, the lantern to flash but only if the lantern receives a synchronization signal from another lantern, and enabling and flashing, when the lantern senses night, the lantern and sending a synchronization signal to the other lanterns to flash.

8. The method of claim 6 wherein sensing the levels of day and night such that while one lantern senses day, another lantern will not measure night.

* * * * *